US007898790B2

(12) United States Patent
Orihara et al.

(10) Patent No.: US 7,898,790 B2
(45) Date of Patent: Mar. 1, 2011

(54) IONIZER

(75) Inventors: Masayuki Orihara, Tsukubamirai (JP); Takayuki Toshida, Tsukubamirai (JP); Akira Tadano, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 168 days.

(21) Appl. No.: 12/410,577

(22) Filed: Mar. 25, 2009

(65) Prior Publication Data

US 2009/0262482 A1 Oct. 22, 2009

(30) Foreign Application Priority Data

Apr. 22, 2008 (JP) ..... 2008-111388

(51) Int. Cl.
*H01T 23/00* (2006.01)

(52) U.S. Cl. ..... 361/230; 361/231

(58) Field of Classification Search ..... 361/212, 361/213, 230, 231
See application file for complete search history.

(56) References Cited

U.S. PATENT DOCUMENTS 4,740,862 A * 4/1988 Halleck ..... 361/231
6,252,233 B1 * 6/2001 Good ..... 250/423 R

FOREIGN PATENT DOCUMENTS

JP 2004-253192 9/2004

OTHER PUBLICATIONS

U.S. Appl. No. 12/478,357, filed Jun. 4, 2009, Orihara, et al.
U.S. Appl. No. 12/503,195, filed Jul. 15, 2009, Orihara, et al.

* cited by examiner

*Primary Examiner* — Danny Nguyen
(74) *Attorney, Agent, or Firm* — Oblon, Spivak, McClelland, Maier & Neustadt, L.L.P.

(57) ABSTRACT

An ionizer is formed by coupling a fan unit provided with a discharge electrode and a fan and a control unit provided with an indicator and an adjuster to each other, and both units are changeable between a normal coupling condition, where both are directed in the same direction, and an opposite coupling condition, where they are directed in opposite directions to each other, and in addition, a power/signal arrangement of the connection terminals of the separate connector is bilaterally symmetrical such that same power and signals ale transmitted and received between the separate connectors of both units connected to each other in either coupling condition of aforementioned both units.

12 Claims, 5 Drawing Sheets

IONIZER

TECHNICAL FIELD

The present invention relates to a fan type ionizer constituted by a fan unit and a control unit.

BACKGROUND ART

In an existing fan type ionizer (refer to Japanese Unexamined Patent Application Publication No. 2004-253192, for example), in a substantially single housing, a discharge electrode generating ions by application of a high voltage, a fan generating air flow to discharge the generated ions from an air outlet of the housing, a high voltage generator for applying a high voltage to the discharge electrode, and a controller for controlling driving of the high voltage generator and the fan are mounted. Normally, an indicator indicating operating states of the ionizer, an adjuster for adjusting operating states of the ionizer, a control connector for connecting various wirings to an external power source for driving the high voltage generator and the fan and also to transmit and receive various electric signals to and from the outside, and the like are provided on a front of the housing provided with the air outlet for the air flow.

However, such fixed provision of an air outlet for air including ions, various indicators, various adjusters, a control connector for various wirings to a housing may sometimes makes it difficult for a worker handling the device to easily view the indicators, depending on the surrounding environment of the installation site of the ionizer, leading to inability to appropriately confirm readings of the indicators, inability to precisely operate the various adjusters, or difficulty in connecting wiring to the control connector.

DISCLOSURE OF INVENTION

A technical problem to be solved by the present invention is to enable changing of the relationship between the orientation of an air outlet for air including ions and the orientation of indicators, adjusters, and the like appropriately in accordance with the installation environment and the like of an ionizer and improving the usability of the ionizer.

Another technical problem to be solved by the present invention is to realize improved usability of the ionizer by simple means at a low cost.

In order to solve the problems, the present invention includes: a fan unit provided, in a first housing, with a discharge electrode generating ions by application of a high voltage and a fan generating air flow to transport the ions generated at the discharge electrode; and a control unit provided, in a second housing, with an indicator indicating an operating state of the ionizer and an adjuster for adjusting an operating state of the ionizer.

The fan unit and the control unit are formed separately from each other, the units being coupled detachably while coupling faces of the first housing and the second housing abut on each other and are also changeable between a normal coupling condition, where both units are oriented in the same direction from front to back, and an opposite coupling condition, where both units are oriented in opposite directions from front to back.

In addition, first and second separate connectors electrically connected to each other when the fan unit and the control unit are coupled are provided on the coupling faces, the separate connectors being connectable to each other in either case of the fan unit and the control unit being in the normal coupling condition or the opposite coupling condition and also having connection terminals with a power/signal arrangement configured such that power supply and signal transmission/reception between both separate connectors is achieved in either coupling condition of both units.

In the present invention, it is preferable that the power/signal arrangement of the connection terminals of at least one of the separate connectors is bilaterally symmetrical.

In the ionizer of the present invention, a concave portion is formed on the coupling face of the first housing, the male type first separate connector is provided inside the concave portion, a convex portion is formed on the coupling face of the second housing, the female type second separate connector is provided inside the convex portion, and when abutting the coupling faces of the first housing and the second housing on each other, the convex portion fits in the concave portion and the first separate connector is inserted in the second separate connector to establish electrical connection.

In the present invention, it is desirable that the first separate connector and the second separate connector are provided at a center, lengthwise and widthwise, of respective coupling faces of the first housing and the second housing.

In addition, in the ionizer of the present invention, it is preferable that the control unit also serves as a base to mount the fan unit, and the coupling faces are formed on an bottom surface of the first housing and a upper surface of the second housing and coupled to the control unit with the fan unit being mounted on the control unit.

In the ionizer of the present invention, a control connector for connecting wiring from an external power source and wiring from another device transmitting and receiving various electric signals may also be provided on a front side of the second housing of the control unit.

In an ionizer having the above configuration, the fan unit and the control unit can be changed between a normal coupling condition and an opposite coupling condition while keeping the same arrangement of power/signal transmitted and received between both units in accordance with the environment of the installation site and the like. This enables changing the orientation of the ail outlet for air including ions relative to various indicators, various adjusters and the like in accordance with the working environment, and compared to conventional ionizers provided with the above in a fixed orientation, the usability of the ionizer is thus improved, such as better viewability of the indicators and easier operation of the various adjusters by a worker. Moreover, the improvement in usability can be realized by simple means at a low cost.

BEST MODE FOR CARRYING OUT THE INVENTION

Figure 1:
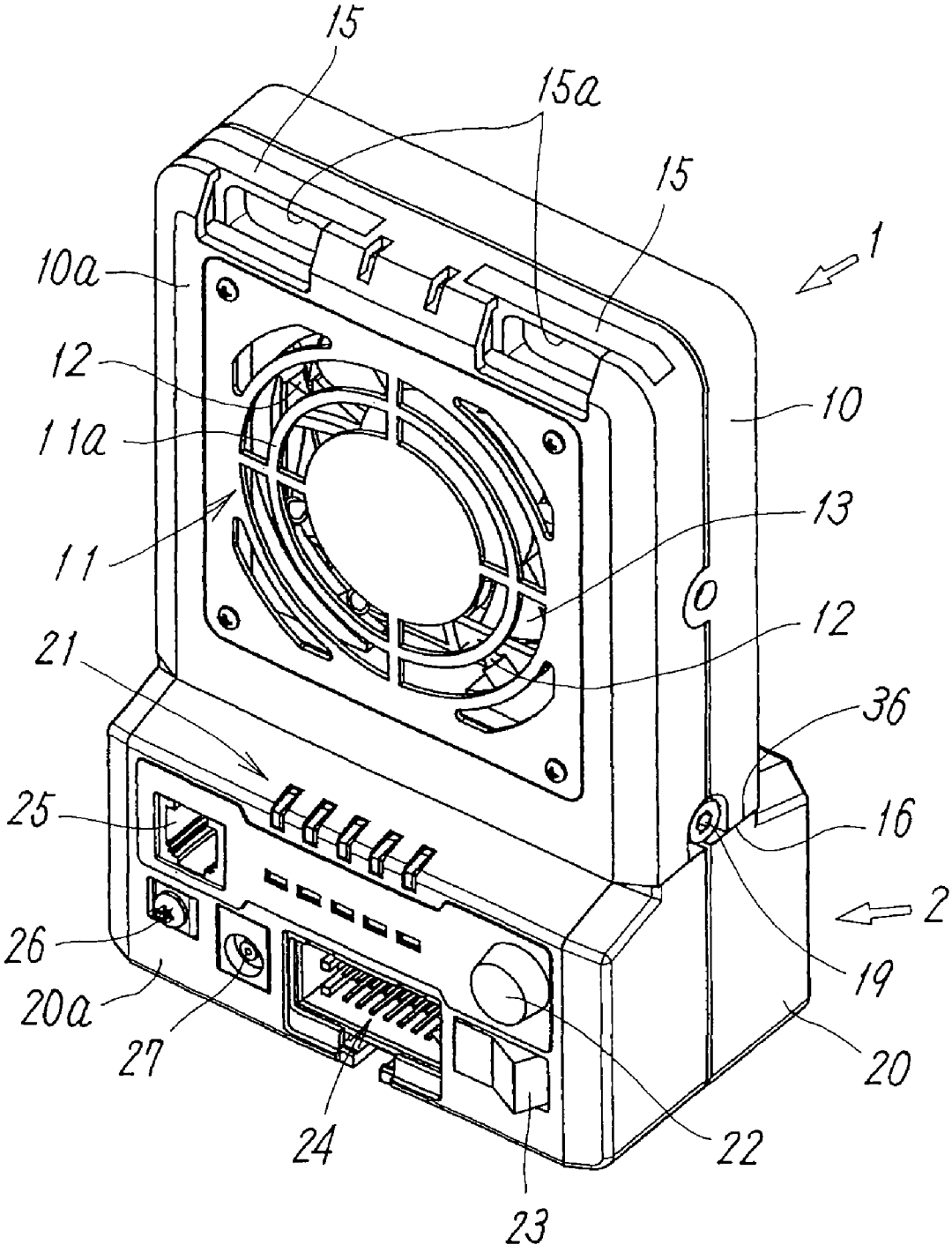
FIG. 1 is a front side perspective view showing an Example of an ionizer according to the present invention.
Figure 2:
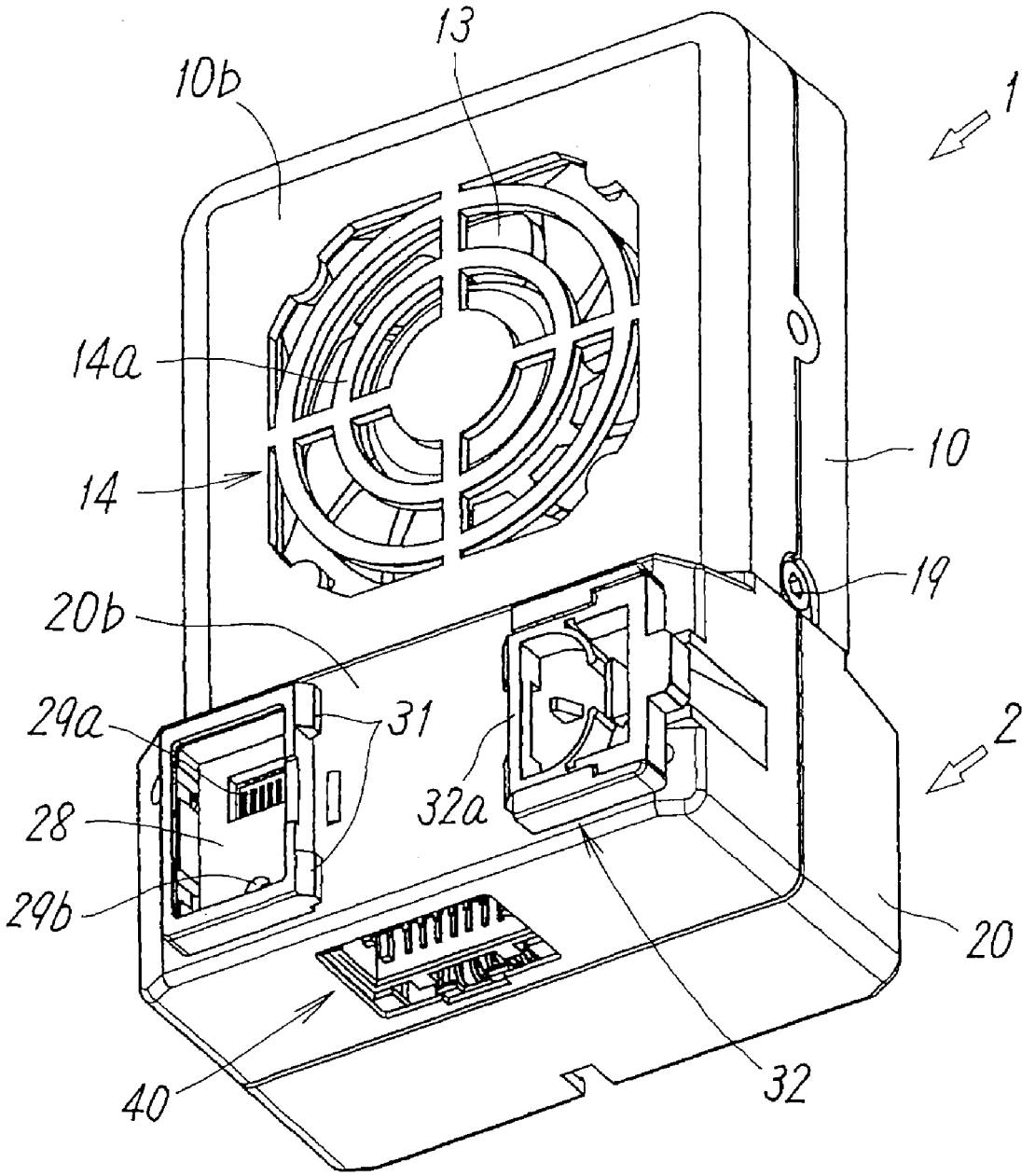
FIG. 2 is a back side perspective view in the Example.

FIGS. 1 and 2 show an Example of an ionizer according to the present invention, and this ionizer is configured with a fan unit 1 and a control unit 2.

Schematically, the fan unit 1 is provided, in a first housing 10 having a square box shape, with a plurality of discharge electrodes 12 generating ions by application of a high voltage generated in a high voltage generator and a fan 13 generating air flow to expel the generated ions from an air outlet 11 of the first housing 10.

In addition, the control unit 2 is provided, in a second housing 20 having a square box shape, with a controller (not shown) to control the high voltage generator (not shown) and the fan 13, and the second housing 20 is provided, on its surface, with indicators 21 and the like described later. The controller controlling an electric circuit forming the high voltage generator and the fan 13 can be provided inside the first housing 10 in the fan unit 1, or inside the second housing 20 in the control unit 2.

The fan unit 1 (refer to FIG. 3) provided with the discharge electrodes 12, the fan 13, and the like in the first housing 10 and the control unit 2 (FIGS. 4-6) provided with the controller and the like in the second housing 20 are formed separately from each other, and as shown in FIGS. 1 and 2, are assembled detachably by coupling the first housing 10 and the second housing 20 to each other.

Figure 3:
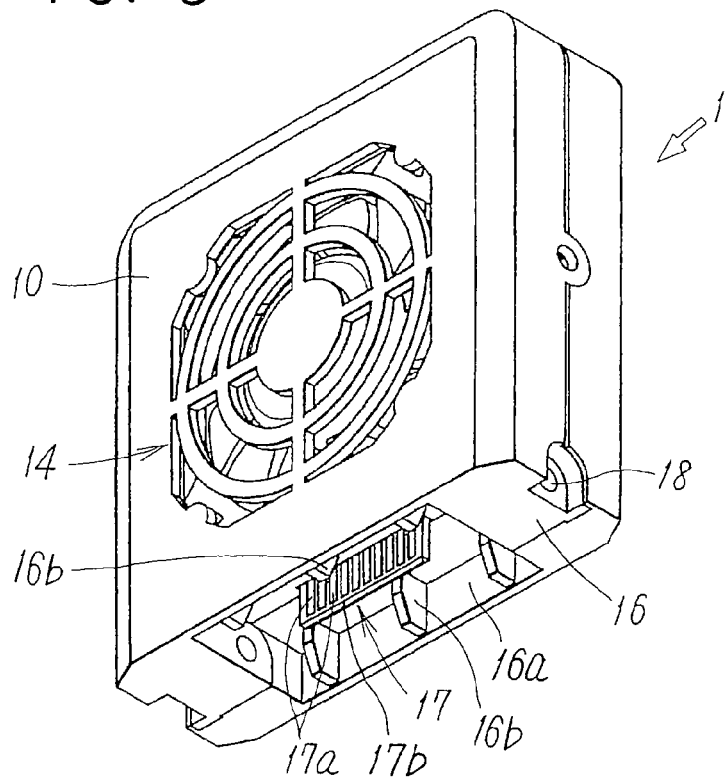
FIG. 3 is a perspective view illustrating an electric connector on a bottom surface of a fan unit in the Example.

As seen from FIGS. 1-3, the fan unit 1 has a finger guard 11a at the air outlet 11 for air flow, which opens on a front 10*a* side of the first housing 10, and an air inlet 14 provided on a back 10*b* side of the first housing 10 also has a finger guard 14*a* similarly, and in addition, finger grooves 15*a* formed in a cartridge 15 holding the discharge electrodes 12 are exposed in the upper portion of the front of the first housing 10. The finger grooves 15*a* accommodate a user's fingers when attaching and detaching the cartridge 15 to and from the first housing 10.

Further, a concave portion 16*a* is formed on a coupling face 16, which is the bottom surface of the first housing 10, and a first separate connector 17 is provided, which is a male connector, inside the concave portion 16*a*. The first separate connector 17 is located at the center of the coupling face 16 lengthwise and widthwise and extends lengthwise of the first housing 10. The first separate connector 17 has a plurality of connection terminals 17*a* installed on both faces of a substrate, and the connection terminals 17*a* are connected to the discharge electrodes 12, the fan 13, the high voltage generator, or the like via a circuit for transmitting and receiving signals, not shown in the drawings. On coupling the fan unit 1 and the control unit 2, the first separate connector 17 is inserted in a second separate connector 37 (refer to FIG. 4), which is a female connector, provided on a coupling face 36 of the second housing 20, and thereby is electrically connected to the second separate connector 37 to transmit and receive power and signals between both units 1 and 2.

Figure 4:
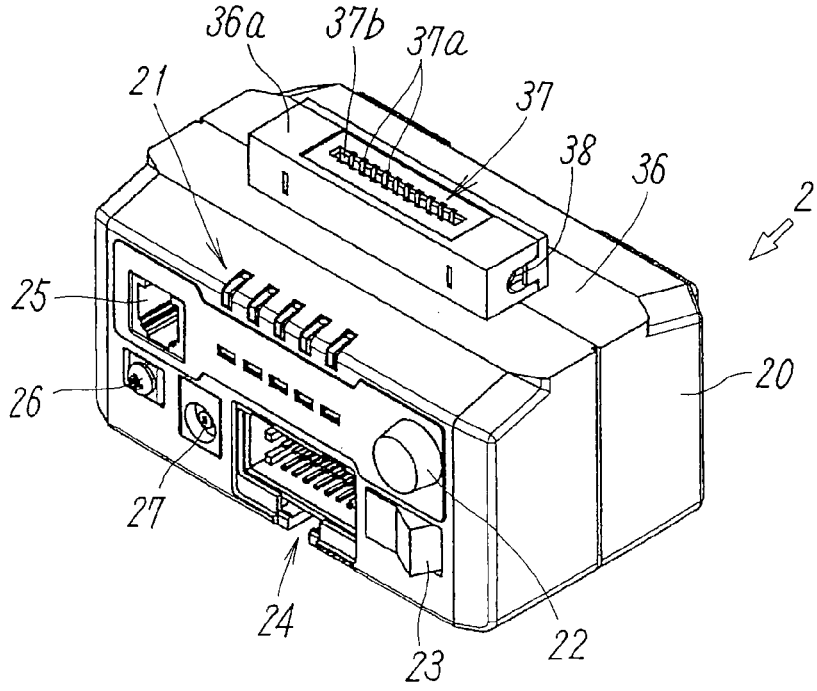
FIG. 4 is a perspective view of a control unit in the Example.
Figure 5:
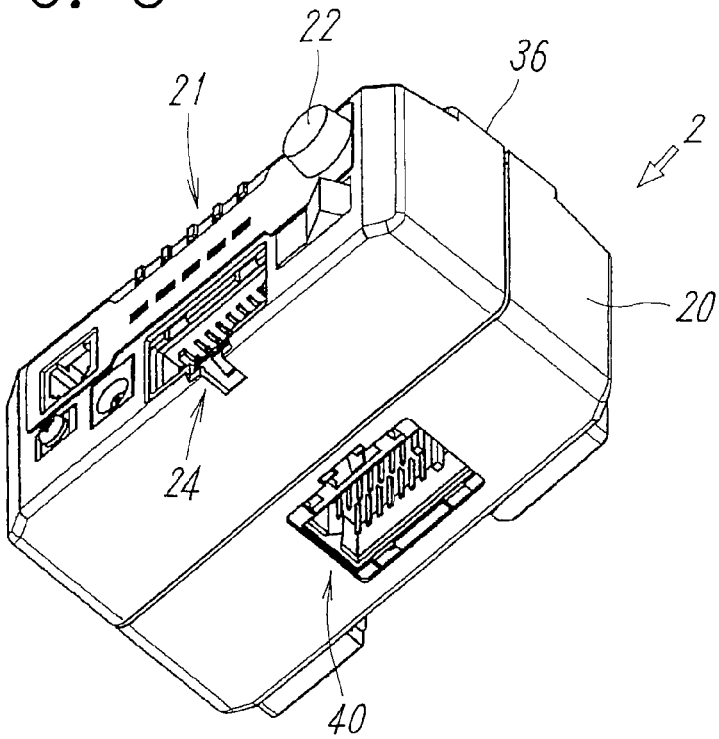
FIG. 5 is a perspective view illustrating an electric connector on a bottom surface of the control unit in the Example.

Meanwhile, as seen from FIGS. 1, 4, and 5, the control unit 2 is provided, on a front 20*a* side of the second housing 20, with the indicators 21 indicating various operating states of the ionizer, such as power indication, discharge indication, defect indication of the fan 13, contamination indication of the discharge electrodes 12, indication of balance of positive and negative ions, and various defect indications, and an adjuster for adjusting the operating states of the ionizer, such as airflow rate of the fan 13. Although a rotary switch 22 for adjusting airflow rate, a power switch 23, and the like are provided as such an adjuster in the Example shown in the drawings, other various adjusters can be provided. In addition, on the front 20*a* side of the second housing 20, a control connector 24 for wiring is provided in order to be connected to an external power source for driving the high voltage generator and the fan 13 and also to transmit and receive various electric signals to and from the outside.

Further, a modular connector 25 for connecting to an external sensor, an FG terminal 26, a DC jack 27 for connecting to an AC adaptor, and the like are provided on the front 20*a* side of the second housing 20.

It should be noted that the front 20*a* side of the second housing 20 means not only the original meaning of the front of the second housing 20, but should be taken as even including an area that is in the vicinity of the front, where it is possible to operate the adjusters and the like from the front side or be easily visible from the front side, and has substantially no difference from the front.

The second housing 20 of the control unit 2 forms, as shown in FIGS. 1 and 2, a base to mount the fan unit 1. For this reason, the width from front to back of the second housing 20 is larger than the width of the first housing 10 and a coupling face 36 is formed on the upper surface of the second housing 20, and the fain unit 1 is mounted on the control unit 2 while the coupling face 36 abuts on the coupling face 16, which is the bottom surface of the first housing 10.

The width of the second housing 20, however, may also be the same as or smaller than the width of the first housing 10. In addition, although in the example shown in the drawings the length from left to right of the first housing 10 and the length of the second housing 20 are equal, the length of the first housing 10 may also be larger or smaller than the length of the second housing 20.

The first housing 10 and the second housing 20 are configured to be coupleable in either condition of normal coupling, where the fan unit 1 and the control unit 2 are oriented in the same direction from front to back, or opposite coupling, where both units 1 and 2 are oriented in opposite directions from front to back. The normal coupling condition is, as shown in FIGS. 1 and 2, a coupling condition where the front 10*a* of the first housing 10 and the front 20*a* of the second housing 20 are oriented in the same direction, and the opposite coupling condition is a coupling condition where the front 10*a* of the first housing 10 and the front 20*a* of the second housing 20 are oriented in opposite directions to each other, in other words, a coupling condition where the front 10*a* of the first housing 10 and a back 20*b* of the second housing 20 are oriented in the same direction.

Therefore, the first separate connector 17 provided in the first housing 10 and the second separate connector 37 provided in the second housing 20 are also connectable to each other in both cases where the fan unit 1 and the control unit 2 are in the normal coupling condition or in the opposite coupling condition, and the power/signal arrangement of the connection terminals 17*a* and 37*a* of both separate connectors 17 and 37 is configured such that the same power and signals are transmitted and received between the separate connectors 17 and 37 in either coupling condition.

The second separate connector 37 is, as shown in FIG. 4, provided at a central position lengthwise and widthwise in the coupling face 36 inside a convex portion 36*a* formed on the coupling face 36 of the second housing 20, and has a connection port 37*b*, and into which, the first separate connector 17 is to be inserted from above, the connection port 37*b* elongatedly extending lengthwise in the second housing 20. In addition, the convex portion 36*a* elongatedly extends lengthwise of the second housing 20, and when the fan unit 1 and the control unit 2 are coupled, is inserted into the concave portion 16*a* of the first housing 10 to be positioned by being fitted in between ribs 16*b* provided in inner walls of the concave portion 16*a*.

Figure 7A:
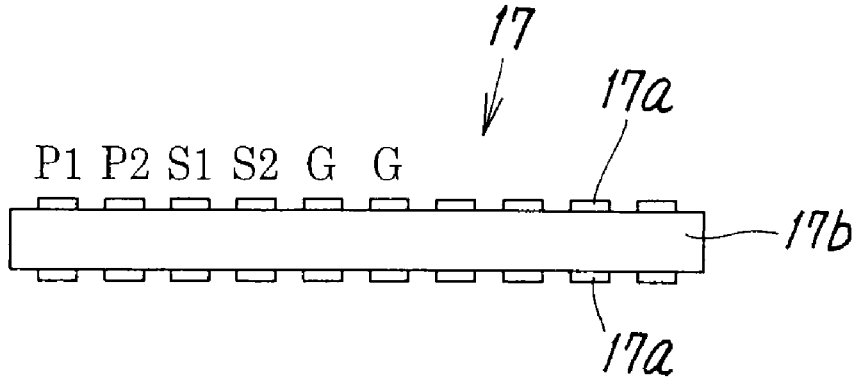
FIG. 7A is a plan view diagrammatically showing a power/signal arrangement of connection terminals of a first separate connector.
Figure 7B:
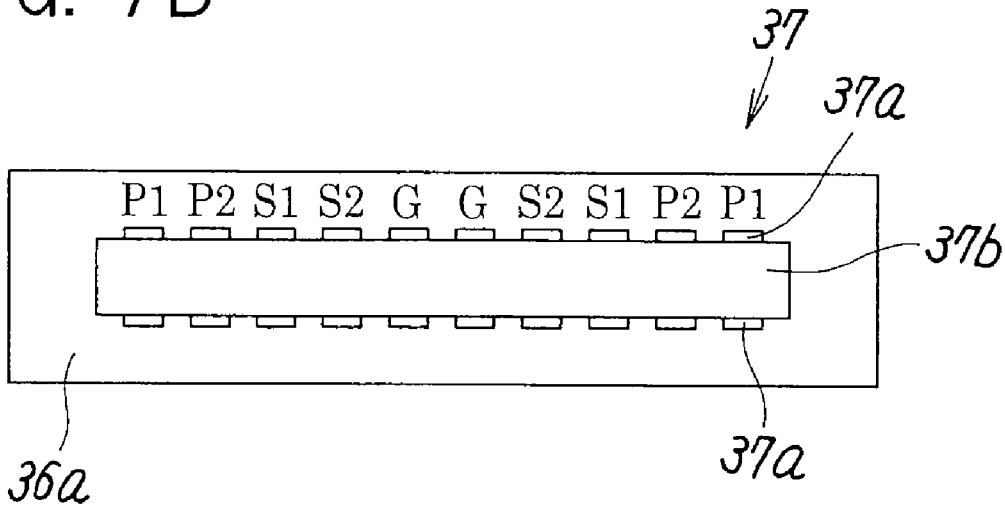
FIG. 7B is a plan view diagrammatically showing a power/signal arrangement of connection terminals of a second separate connector.

FIGS. 7A and 7B show an example of the power/signal arrangement in the connection terminals 17*a*, 37*a* of the separate connectors 17, 37.

The first separate connector 17 shown in FIG. 7A has ten pairs of connection terminals 17*a* in total, counting two connection terminals 17*a* facing each other on each face of a substrate 17*b* as one pair, and the connection terminals 17*a* are connected to predetermined components or parts as, sequentially from the left side of the figure, terminals for power P1 and P2, terminals for signals S1 and S2, and terminals for grounding G and G, and the remaining four pairs of the connection terminals 17*a* are left unconnected. The two terminals for grounding G and G both can be used in the same way. The connection terminals 17*a* of the first separate connector 17 are arranged, therefore, with directionality in terms of connection. It should be noted that each pair of connection terminals 17*a* facing each other are electrically connected to each other.

In contrast, the second separate connector 37 shown in FIG. 7B has ten pairs of connection terminals 37*a* in total, counting two connection terminals 37*a* facing each other across the connection port 37*b* as one pair, and the connection terminals 37*a* are connected to predetermined components or parts as, sequentially from the left side of the figure, terminals for power P1 and P2, terminals for signals S1 and S2, terminals for grounding G and G, terminals for signals S2 and S1, and terminals for power P2 and P1. The connection terminals 37*a* of the second separate connector 37, therefore, have a bilaterally symmetrical power/signal arrangement, and the same power and signals are transmitted and received between both separate connectors 17 and 37 whether the first separate connector 17 is connected in the direction shown in FIG. 7A or connected in the opposite direction lengthwise. It should be noted that each pair of the connection terminals 37*a* facing each other are electrically connected to each other.

However, the power/signal arrangement of the connection terminals 17*a* of the first separate connector 17 may also be bilaterally symmetrical and directionality may be given to the power/signal arrangement of the connection terminals 37*a* of the second separate connector 37. Alternately, the power/signal arrangements of the connection terminals 17*a* and 37*a* of both separate connectors 17 and 37 can also be bilaterally symmetrical.

In order to fix the first housing 10 and the second housing 20 in a coupling condition, a bolt inserted through hole 18 extending lengthwise of the first housing 10 and reaching the concave portion 16*a* is opened near the lower edge adjacent to the coupling face 16 on end faces of both sides of the first housing 10, and meanwhile, a screw hole 38 is provided at a position corresponding to the bolt inserted through hole 18 on end faces of both sides of the convex portion 36*a* formed on the coupling face 36 of the second housing 20, and by screwing the bolt 19) inserted through the bolt inserted through hole 18 into the screw hole 38, the first housing 10 and the second housing 20 are mutually fixed.

Even in a case that the first housing 10 is mounted on the second housing 20 in the condition of being directed opposite from front to back to the case shown in the drawings (opposite coupling condition), the bolt inserted through hole 18 and the screw hole 38 can fix both housings 10 and 20 mutually with the bolt 19.

In this case, even when the control unit 2 is coupled to the fan unit in either normal or opposite direction, both units remain in the unchanged orientation lengthwise and widthwise.

However, fixation of the first housing 10 and the second housing 20 may also be carried out from the front side or the back side by providing two such bolt inserted through holes 18 in alignment in the lower edge of the front or back of the first housing 10 and also providing two such screw holes 38 in alignment respectively for the front and the back of the convex portion 36*a*.

In addition, as seen from FIG. 2, DIP switches 29*a* for setting functions and an adjuster 29*b* for finely adjusting ion balance are provided in a concave portion 28, on which a lid can be put, on the back 20*b* side of the second housing 20. It should be noted that the lid to be put on the concave portion 28 is omitted in the figure.

Figure 6:
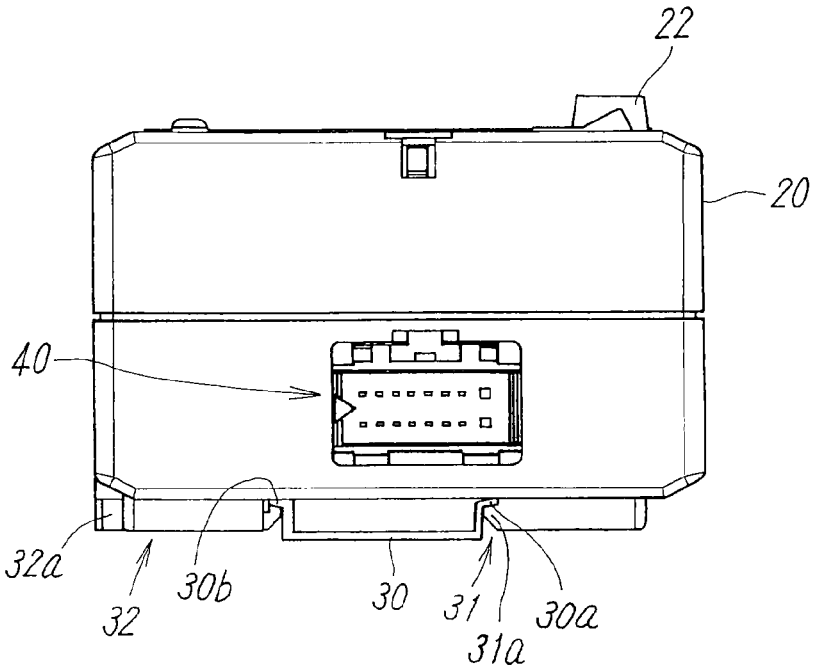
FIG. 6 is a bottom view showing an installation embodiment of the control unit relative to a DIN rail.

Further, on the back 20*b* side of the second housing 20, as seen from FIGS. 2 and 6, installation members 31, 32 are laid to install the second housing 20 of the control unit 2 on a DIN rail 30 fixed on a wall or the like. One of the installation members 31 is fixedly provided with the second housing 20 and has hooks 31*a* on the edge to engage the hooks 31*a* on one of rail edges 30*a* of the DIN rail 30. In addition, the other of the installation members 32 is provided with a movable engagement member 32*a* engaging on the other of the rail edges 30*b* of the DIN rail 30 and is configured to elastically engage the movable engagement member 32*a* with the rail edge 30*b*.

Although the second housing 20 of the control unit 2 generally forms a base for the fan unit 1 and is configured to be used such that the fan unit 1 is mounted on the control unit 2 put on an installation platform, the control unit 2 can also be fixed on a wall or the like, from where the indicators 21 are easily visible, using the DIN rail 30 as described above. In this case, the fan unit 1 is supported by an appropriate bracket and disposed at a separate position from the control unit 2, and the separate connectors 17, 37 provided on each coupling face 16, 36 of the fan unit 1 and the control unit 2 are connected to each other with a separately provided separate cable, omitted in the drawings, thereby to be configured such that the power/signal is transmitted and received between corresponding terminals.

In addition, as shown in FIGS. 2 and 5, a link connector 40 is provided on the bottom surface of the second housing 20 of the control unit 2. The link connector 40 has the same structure as that of the control connector 24 and is parallel connected with the connector 24, and in such cases as a plurality of ionizers are used in parallel, and as a plurality of control units 2 are collectively installed on the DIN rail 30 described above to connect the control units 2 and the fan units 1 with the separate cable for use, it can be used for transmitting and receiving the power/signal to and from the terminals at corresponding positions by connecting a control connector 24 on one side of a next ionizer and a link connector 40 on the other side respectively with the separate cable to construct crossover wiring as a whole. Carrying out such a crossover wiring enables to turn on all ionizers by turning on one of the ionizers. Although the link connector 40 is provided with a cover for covering it when not used, it is omitted in the drawings.

The invention claimed is:

1. An ionizer comprising: a fan unit provided, in a first housing, with a discharge electrode generating ions by application of a high voltage and a fan generating air flow to convey the ions generated at the discharge electrode; and a control unit provided, in a second housing, with an indicator indicating an operating state of the ionizer and an adjuster for adjusting an operating state of the ionizer, wherein the fan unit and the control unit are formed separately from each other, the units being coupled detachably while coupling faces of the first housing and the second housing abut on each other and are also changeable between a normal coupling condition, where both units are oriented in the same direction from front to back, and an opposite coupling condition, where both units are oriented in opposite directions from front to back, and first and second separate connectors electrically connected to each other when the fan unit and the control unit are coupled are provided on the coupling faces, the separate connectors being mutually connectable in either case of the fan unit and the control unit being in the normal coupling condition or the opposite coupling condition and also having connection terminals with a power/signal arrangement configured such that power supply and signal transmission/reception between both separate connectors is achieved in either coupling condition of both units.

2. The ionizer according to claim 1, wherein the power/signal arrangement of the connection terminals of at least one of the first and second separate connectors is bilaterally symmetrical.

3. The ionizer according to claim 1, wherein a concave portion is formed on the coupling face of the first housing, the male type first separate connector is provided inside the concave portion, a convex portion is formed on the coupling face of the second housing, the female type second separate connector is provided inside the convex portion, and when abutting the coupling faces of the first housing and the second housing on each other, the convex portion fits in the concave portion and the first separate connector is inserted in the second separate connector to establish electrical connection.

4. The ionizer according to claim 2, wherein a concave portion is formed on the coupling face of the first housing, the male type first separate connector is provided inside the concave portion, a convex portion is formed on the coupling face of the second housing, the female type second separate connector is provided inside the convex portion, and when abutting the coupling faces of the first housing and the second housing on each other, the convex portion fits in the concave portion and the first separate connector is inserted in the second separate connector to establish electrical connection.

5. The ionizer according to claim 1, wherein the first separate connector and the second separate connector are provided at a center of a horizontal direction and a front-back direction of respective coupling faces of the first housing and the second housing.

6. The ionizer according to claim 2, wherein the first separate connector and the second separate connector are provided at a center of a horizontal direction and a front-back direction of respective coupling faces of the first housing and the second housing.

7. The ionizer according to claim 3, wherein the first separate connector and the second separate connector are provided at a center of a horizontal direction and a front-back direction of respective coupling faces of the first housing and the second housing.

8. The ionizer according to claim 1, wherein the control unit also serves as a base to mount the fan unit, and the coupling faces are formed on a bottom surface of the first housing and an upper surface of the second housing and coupled to the control unit with the fan unit being mounted on the control unit.

9. The ionizer according to claim 3, wherein the control unit also serves as a base to mount the fain unit, and the coupling faces are formed on a bottom surface of the first housing and an upper surface of the second housing and coupled to the control unit with the fan unit being mounted on the control unit.

10. The ionizer according to claim 5, wherein the control unit also serves as a base to mount the fan unit, and the coupling faces are formed on a bottom surface of the first housing and an upper surface of the second housing and coupled to the control unit with the fan unit being mounted on the control unit.

11. The ionizer according to claim 1, wherein a control connector to connect wiring from an external power source and wiring from another device transmitting and receiving various electric signals is provided on a front side of the second housing of the control unit.

12. The ionizer according to claim 3, wherein a control connector to connect wiring from an external power source and wiring from another device transmitting and receiving various electric signals is provided on a front side of the second housing of the control unit.

* * * * *